United States Patent [19]

Suttle et al.

[11] Patent Number: 4,948,134

[45] **Date of Patent: * Aug. 14, 1990**

[54] ELECTRONIC POKER GAME

[75] Inventors: James P. Suttle, Las Vegas, Nev.; Daniel A. Jones, Louisville, Ky.

[73] Assignee: Caribbean Stud Enterprises, Inc., Las Vegas, Nev.

[ * ] Notice: The portion of the term of this patent subsequent to Jun. 6, 2006 has been disclaimed.

[21] Appl. No.: 443,884

[22] Filed: Nov. 27, 1989

Related U.S. Application Data

[60] Division of Ser. No. 218,152, Jul. 13, 1988, which is a continuation-in-part of Ser. No. 182,374, Apr. 18, 1988, Pat. No. 4,836,553.

[51] Int. Cl.[5] ..... A63F 1/00

[52] U.S. Cl. ..... 273/85 CP; 273/85 G; 273/274

[58] Field of Search ..... 273/85 CP, 85 G, 274, 273/237, 292

[56] References Cited

U.S. PATENT DOCUMENTS 3,876,208 4/1975 Wächtler et al. ..... 273/85 CP
4,836,553 6/1989 Suttle et al. ..... 273/292

*Primary Examiner*—Edward M. Coven
*Assistant Examiner*—Valerie Szczepanik
*Attorney, Agent, or Firm*—Quirk, Tratos & Roethel

[57] ABSTRACT

An electronic device is used to play a card game in which a player and a dealer are each dealt five cards. If the dealer has a poker hand having a value less than an Ace-King combination or better, the player automatically wins. If the dealer has a poker hand having a value of an Ace-King combination or better, then the higher of the player's or the dealer's hand wins. If the player wins, he receives a bonus payment depending on the poker rank of his hand. By making an additional wager, a player can also participate in a progressive jackpot component of the card game.

38 Claims, 2 Drawing Sheets

FIGURE I.

ELECTRONIC POKER GAME

CROSS REFERENCE TO RELATED APPLICATION:

This is a divisional of copending application Ser. No. 218,152 filed on 7,13,88 which is a Continuation-in-Part of Application Ser. No. 182,374, filed Apr. 18, 1988 now U.S. Pat. No. 4,836,553 and entitled "Poker Game."

BACKGROUND OF THE INVENTION

The present invention generally relates to a game of chance that can be played in a casino version or a cardroom version. More particularly, it relates to a modified version of a five-card stud poker game.

A player and a dealer are each dealt five card poker hands using a standard deck of playing cards. The high hand wins based on the priority of hands established under conventional five card poker rules. However, the player automatically wins if the dealer does not have at least a preselected combination of cards, e.g., an Ace-King combination or better in the dealer's hand. The player also receives a bonus payment depending on the type of poker hand that the player has if the player's hand beats the dealer's hand.

As a leisure time activity, poker and other card games have fascinated the public for years. A deck of cards, a playing surface and a few participants are all that is needed to provide a recreational few hours away from the stress and strain of daily life. Five card poker is a game that almost everyone knows how to play and many games have been developed using the same basic priority or rank order of winning poker hands: Royal Flush, Straight Flush, Four of a Kind, Full House, Flush, Straight, Three of a Kind, Two Pair, One Pair and High card(s) in Hand.

For one reason or another, it has been difficult to adapt the rules of poker into a casino table game in which each player plays against the house. In a conventional poker game, a plurality of players are each dealt a poker hand by one player who acts as the dealer. The player with the highest hand based on the established priority of poker hands wins. Each player in turn deals a hand as the game continues. It is not unknown to introduce wagering into the game, generally through the use of tokens or poker chips, which may or may not have a monetary value.

Many places, both within and without the United States, have legalized gaming and poker is one of the games of chance that is offered in both casinos and cardrooms. In a conventional cardroom poker game, the house provides a dealer, the playing cards, the table and chairs but does not play a hand. The house collects a nominal percentage of each player's bet (the "rake") which compensates the house for providing the facilities to the players. Alternatively, the house may charge each player a set amount per hand or for a specified length of time, say one-half hour. Each player is competing not against the house, but against all the other players with the highest hand winning the total of all the wagers made on that hand.

Many people do not like to play cardroom poker because each player is competing against his fellow players, not against the house. Many people would rather attempt to win money from an impersonal source, the house or the casino, rather than from their fellow players with whom they may be acquainted.

Cardroom poker also does not offer any bonus payments for particularly good hands. While a Royal Flush is a rare occurrence and generates a thrill for any poker player, the player collects the same total wager that he would have collected if all he needed to beat the other players was Three of a Kind.

It is an object of the present invention to provide a game of chance in which each player plays his poker hand against a poker hand held by the house or a banker and in which a player receives a bonus payment based on the type of poker hand that a player holds. It is a further object of the present invention to provide a game in which a player may win all or a portion of a progressive jackpot if the player is dealt a particularly high ranking poker hand.

Other objects of the invention will become apparent in light of the following detailed description of the invention.

BRIEF SUMMARY OF THE INVENTION

A modification of a conventional five-card stud poker game particularly adapted for casino play is provided in which a dealer (or "banker") plays against each of a plurality of players. In the preferred method of play, after each player places an ante in a designated location, the dealer deals five cards to each player and to himself; all cards are dealt face down except one of the dealer's cards. Each player views his hand and then decides whether to continue to play by making an additional bet or to fold or drop (i.e., retire), in which case he loses his ante. The dealer then reveals his entire hand; if the dealer's hand does not have a poker value of at least Ace-King, then the dealer is not permitted to continue to play. In this case, the dealer pays even money on the remaining players' antes, and returns their bets to them. If the dealer's hand has a poker value of Ace-King or better, the dealer compares his hand to each player, paying or collecting the bets as appropriate. The dealer also pays odds of more than even money on each winning player's hand of two pair or better according to a bonus payment schedule.

The game of the present invention can also be played in an electronic version utilizing a video display terminal similar to a slot machine or a video poker machine. The player initiates the play by inserting a gaming token into a coin acceptor. The dealer's hand and the player's hand are both displayed on a video display terminal. If the player wishes to continue to play the hand, an additional gaming token is inserted into the coin acceptor. The rules of the game and the payoffs to the player are the same as those of the live version of the game.

DETAILED DESCRIPTION OF THE INVENTION

Figure 1:
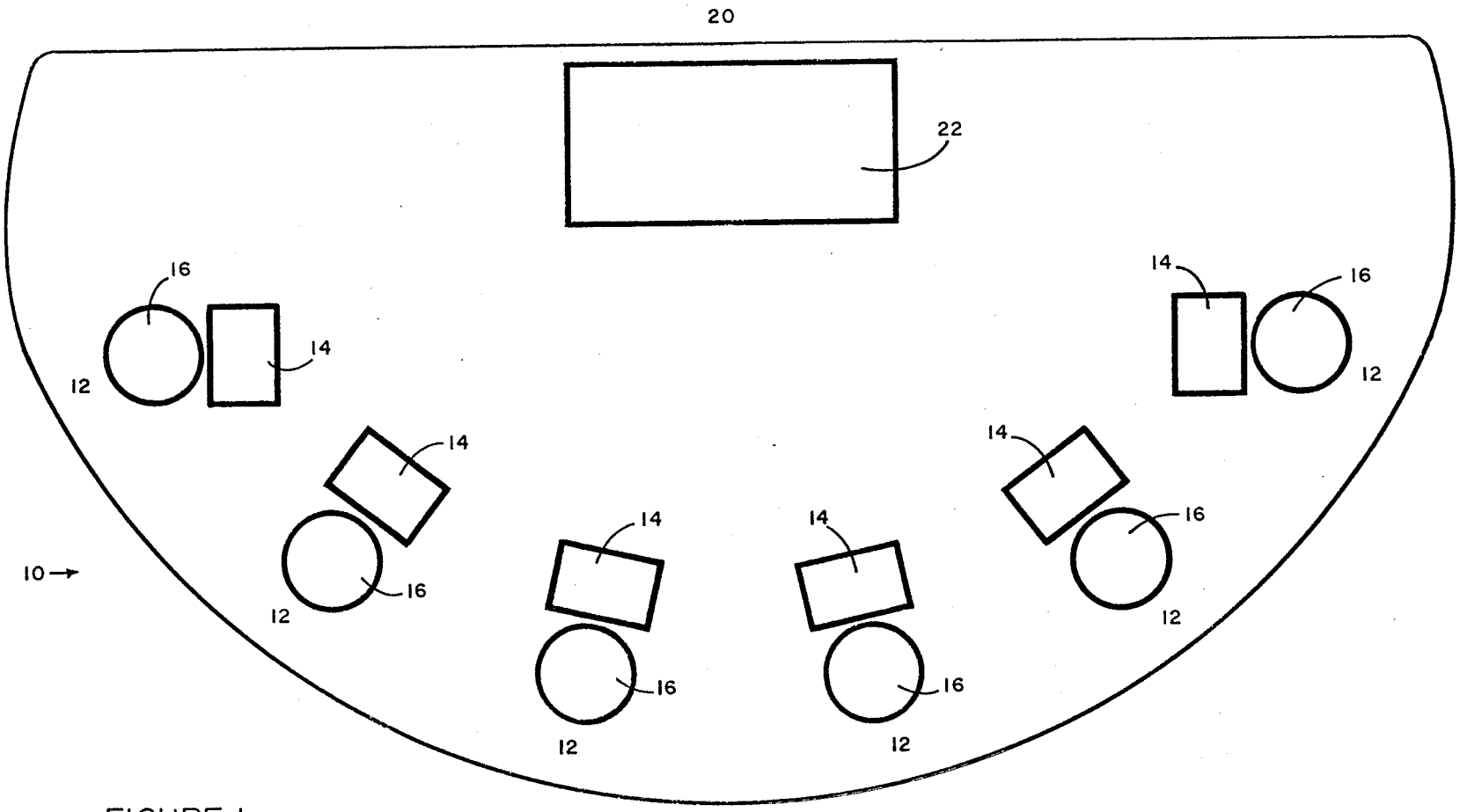
FIG. 1 shows a game layout that can be used to play the poker game of the present invention.

The casino game version of the present invention will be described with reference to the casino game version layout 10 shown in FIG. 1. The term "casino game" is intended to encompass a game in which the house acts as the banker, the house collecting all losing wagers and paying all winning wagers. The dealer is employed by the house and each player plays exclusively against the house.

The layout 10 would be mounted for use on the top of a conventional gaming table (not shown) positioned at a suitable location in a casino. Playing locations 12 are provided for each player. Each playing location 12 has designated areas 14 and 16 for the player to make an "ante" and a "bet", respectively, which will be more fully explained herein. In the preferred embodiment, six playing locations 12 are provided, but the number of playing locations 12 can be varied depending on the size of the playing table and the number of players that the house wishes to accommodate. A typical casino layout will accommodate five, six or seven players per table.

A dealer's location 20 is provided opposite the playing locations 12 and is preferably adjacent to a chip rack 22. The chip rack 22 is of a conventional design used to hold poker chips or other gaming tokens. The dealer uses the chip rack 22 to store the gaming tokens that belong to the house. When a player loses his wager to the house, the gaming tokens won by the house are stored in the chip rack 22. When a player wins his wager from the house, the player is paid from the gaming tokens stored in the chip rack 22.

Standard playing cards are used to play the game. Any number of decks of cards may be used, but in the preferred embodiment, a single deck of standard playing cards is used which is reshuffled after each round is played. The dealer shuffles the cards, each player makes an ante by placing a token or chip in the ante area 14 and then the dealer deals one card at a time to each player and then one card to himself until each player and the dealer has a five card hand. All of each player's cards are dealt face down, while four of the dealer's cards are dealt face down and the other card face up.

Each player may look at his five card hand and each player then decides whether his five card hand has a favorable probability of ultimately beating the dealer's five card hand. The player is assisted in this determination because the player can see one of the dealer's cards.

The priority of winning hands is determined by the conventional rules of poker. As is known to those skilled in the art, five card poker hands are ranked according to the following order with a Royal Flush being the highest winning hand:

1. Royal Flush
2. Straight Flush
3. Four of a Kind
4. Full House
5. Flush
6. Straight
7. Three of a Kind
8. Two Pair
9. One Pair
10. High Card in Hand If a player determines that his hand will not beat the dealer's hand, the player folds or drops, i.e., discontinues playing that hand. The dealer wins the player's ante and takes the player's token from the ante area 14 on the playing surface 10 and places it in the chip rack 22.

If the player determines that his hand may beat the dealer's hand, then the player indicates his willingness to continue play by placing a bet in the bet area 16 on the playing surface 10. The bet made by the player is preferably equal to a multiple (e.g., double) of whatever the player originally anted.

After each player has either bet or folded, all cards are turned face up. Each remaining player places his five card hand in front of him on the playing surface 10 while the dealer's cards are all turned face up in front of the dealer on the playing surface 10.

If the dealer does not have a poker hand at least equal to a predetermined rank or minimum play level, e.g., an Ace-King combination or better, the game does not go forward, and the dealer pays each remaining player a predetermined amount, e.g., one-to-one odds on the amount of the player's ante. The amount of the player's bet is simply returned to the player. All cards are collected, the dealer shuffles the cards and the next round can be played.

If the dealer has a poker hand of at least the preselected rank or minimum (Ace-King or better), then play proceeds and each remaining player's hand is compared to the dealer's hand. If the dealer's hand is higher based on the conventional priority or ranking of five card poker hands, then the dealer wins and he collects both the player's ante and bet. If the dealer's and player's hands are equal, the hand is ruled a tie and the player keeps his bet and his ante.

If the player's hand is higher, the player wins and the dealer pays the player a first predetermined amount, e.g., one-to-one odds, on the amount of the player's ante regardless of the type of poker hand the player has. The dealer also pays the winning player a second predetermined amount, e.g., one-to-one odds on his bet unless the player has received a hand which exceeds a minimum win level, in which case, instead of paying one-to-one odds, the dealer pays the player a bonus payment on the amount of the player's bet based on the type of poker hand that the player has. The bonus payment may be paid according to the following preferred bonus payment schedule:

| Type of Hand | Bonus Payment Odds |
|---|---|
| Royal Flush | 250-to-1 |
| Straight Flush | 50-to-1 |
| Four of a Kind | 20-to-1 |
| Full House | 7-to-1 |
| Flush | 5-to-1 |
| Straight | 4-to-1 |
| Three of a Kind | 3-to-1 |
| Two Pair | 2-to-1 |

After the dealer has paid the winning players and collected from the losing players, the cards are gathered up, the dealer shuffles the cards and the next round can be played. While the bonus payment odds in the above table are a preferred example of a payout schedule, different odds can be used within the spirit of the invention.

The cardroom game version of the present invention can be played on a table layout similar to the casino game version shown in FIG. 1. The layout is placed on a conventional card room poker table, which is usually larger than a casino game table. A card room poker table may accommodate up to ten players and a dealer.

The term "cardroom game" is intended to encompass a game in which one of the players acts as the banker and the banker's poker hand is played against each of the other player's hands. The other players do not play against each other, only individually against the banker.

As in a conventional cardroom poker game, the house provides a dealer and the playing facilities and collects a "rake". The rake may be a percentage of each player's ante, of each player's bet or of the total amounts wagered on each hand. Alternatively, the house may charge each player a flat fee for each hand played or the house may charge a fee based on the length of time that a player participates. The house, however, does not collect losing wagers or pay winning wagers. This arrangement is necessary because some states, such as California, have only legalized cardroom gaming but do not have legalized casino gaming.

In this cardroom version of the present invention, a plurality of player locations are provided around the perimeter of the playing surface. Each playing location is provided with an ante area and a bet area. A dealer, provided by the house, is stationed at a dealer's location. Because the house does not actually participate in the play of the cardroom version of the game, the dealer's sole function is to deal the cards and to collect the house's rake, as well as resolve disputes among the players.

At the beginning of the hand, one of the players is selected to act as banker. The players may cut the cards with the high card being the banker; although other selection procedures may be utilized to choose the banker, such as rolling five dice with the high total being banker. As consecutive rounds of the game are played, the designation as banker shall be passed from player to player around the table. A suitable indicator, such as a button or marker with the letter B or the word BANKER printed thereon, can be placed in front of the player who is designated as banker for that particular round of play.

All of the players, except the banker, ante by placing a token in the ante area. The house dealer deals, one at a time, five cards to each player including the banker. The banker gets four cards face down and one card face up. All the other players get their five cards face down. From this point on, the play continues as described above with regard to the casino game version with each player competing only against the banker. Each player bets or folds; if a player folds, the banker wins the amount of the player's ante and adds this to the banker's supply of tokens, and the player retains his bet. If any remaining players bet, all cards are turned face up. If the banker has less than an Ace-King combination, the banker cannot play further and each remaining player is paid one-to-one odds based on only his ante from the banker's own supply of tokens and the player simply keeps his bet.

If the banker has at least an Ace-King combination or better, play continues and the banker compares poker hands with each player with the higher hand winning. If the banker wins, he collects a player's ante and bet and adds it to the banker's supply of tokens. If a player wins, the banker pays that player from the banker's own supply of tokens including paying that player any bonus payment to which the player may be entitled according to a predetermined bonus payment schedule, such as the one previously described in connection with the casino game version.

At the end of each round, the house dealer collects the cards and shuffles, the "banker" designation is passed on to the next player and a new round can be played.

Either the casino game version or the card room game version may be made even more exciting or entertaining by the addition of a "progressive jackpot" feature. At the beginning of each round, a player may participate in a progressive jackpot by making an additional jackpot wager of any predetermined amount, e.g., one token. The amount of each player's jackpot wager is added to the jackpot wagers that are made by other players on that round or that have been made previously by the players during earlier rounds.

If a player has made a jackpot wager on a particular round, the player becomes eligible to win all or a portion of the jackpot amount if a player holds a predetermined poker hand during that round. For example, in the preferred embodiment, if the player's hand is a Royal Flush, the player wins 100% of the progressive jackpot amount. Other types of poker hands will win for the player other percentages of the jackpot, e.g., a Straight Flush wins 10%, and a Four of a Kind wins 1%. Additionally, the player wins a predetermined number of tokens for other types of poker hands, e.g. 50 tokens for a Full House and 25 tokens for a Flush. The types of poker hands that share in the jackpot, as well as the percentages and predetermined number of tokens, can be varied without departing from the spirit of the invention.

The appeal of the jackpot wager is heightened by its progressive nature. As each round is played, the jackpot wagers made on each hand are added to the previous jackpot amount thereby creating a "progressive jackpot" amount. In the event a player wins all or part of a progressive jackpot, the amount won is deducted from the jackpot amount and the subsequent jackpot wagers are added thereto.

If a progressive jackpot is being conducted in connection with a casino or cardroom, the house may collect a percentage of each jackpot wager, e.g., 3—5%, as the house's fee for providing the progressive jackpot feature. If the casino or cardroom has a plurality of tables, each having six or seven players, all contributing to the progressive jackpot, the amount of the jackpot can increase quite quickly thereby making a tidy sum to be distributed to a winning player.

It is contemplated that the game may be played as a casino game, a card room game or even a parlor game, and any form of counting may be used for the ante means or bet means, including tokens, poker chips, currency, coins, or the like, as means for keeping score.

Various modifications can be made without varying from the scope of the invention. Either version of the game can be played using wagering tokens that do not have a monetary value. Instead the players can bet, win and lose points so that, after a designated number of rounds, the player with the highest total of points can be declared the winner. The progressive jackpot feature can also be utilized with the players contributing points to the progressive jackpot and winning percentages of those points for certain predetermined poker hands. This adds excitement to the game since a player who is far behind on points can possibly win the entire game if he is dealt a Royal Flush.

The odds paid on the bonus payment schedule can be adjusted in any manner desirable; the preferred odds set forth herein were selected to return a reasonable profit to the house in the casino game version. Additionally, the game can be played by placing a maximum payout on any particular hand regardless of the number of tokens that are wagered by a particular player. For example, a maximum payout of 1,000 tokens can be used. This limits the risk to the banker in the card room version of the game in the event that a player receives a Royal Flush and has 100 tokens bet. This maximum payout feature can also be used in the casino game version and has the added incentive of encouraging players to participate in the progressive jackpot feature of the game.

Figure 2:
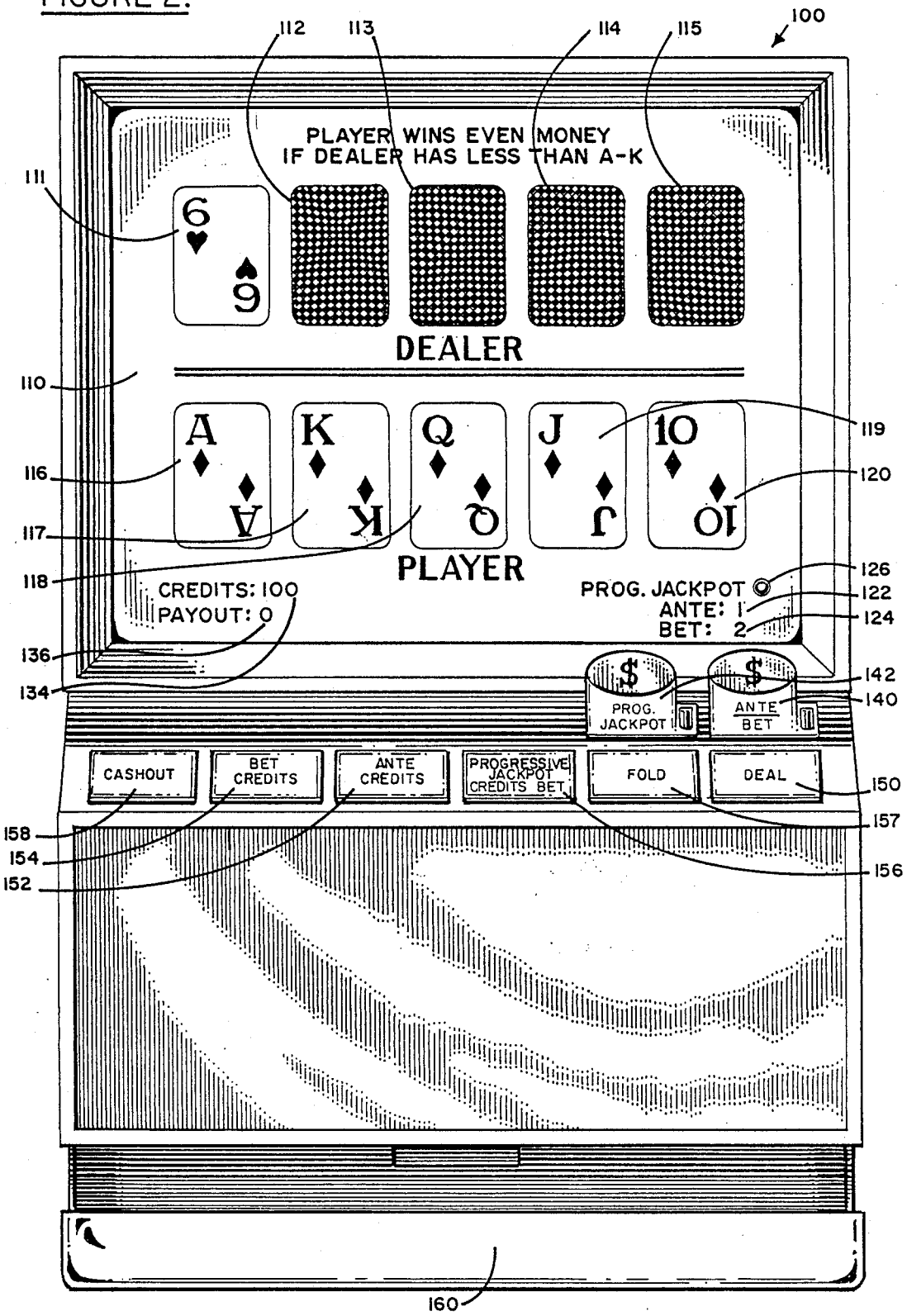
FIG. 2 shows an electronic video machine upon which the poker game of the present invention can be played.

Another embodiment of the present invention is shown in FIG. 2 in which an electronic device 100 is used to play the electronic version of the game. A video display screen 110 displays the five cards 111, 112, 113, 114 and 115 of the dealer's hands as well as the five cards 116, 117, 118, 119 and 120 of the player's hand. A LED display shows the number of coins "anted" 122 by the player and the number of coins "bet" 124 by the player. A progressive jackpot indicator light 126 is illuminated if the player is participating in the progressive jackpot component of the game. Another LED display shows the number of credits remaining 134 and the number of coins paid out 136. Two coin acceptors are provided; one for the ante/bet 140 and one for the progressive jackpot 142. Control buttons are provided on the machine to operate the following functions: deal 150, ante credits 152, bet credits 154, progressive jackpot credits bet 156, fold 157 and cashout 158. The ante credits 152, bet credits 154 and progressive jackpot credits bet 156 buttons can be utilized whenever the player has credits 134 from previous winning hands. The activation of the cash out button 158 causes gaming tokens to be dispensed from a hopper inside the machine ( not shown) into the tray 160. The payout LED 136 will register the number of coins dispensed into the tray which is the number shown in the credits.

Whenever a player achieves a winning hand, the credits LED display 134 is incremented by the amount that the player has won. The winning player receives the same payoffs as those from the live game. The game of the present invention is played electronically in a manner similar to the live game, except that the electronic device 100 replaces the dealer. A player places a gaming token into the ante/bet coin acceptor 140 and presses the deal button 150. This activates the electronic device 100 and the player's five card hand and the dealer's five card hand appear on the video display screen 110. Each of the cards 111, 112, 113, 114 and 115 of the player's hand are displayed face up. The first card 116 of the dealer's hand is displayed face up while the remaining cards 117, 118, 119 and 120 of the dealer's hand are displayed face down. The player evaluates his hand and decides whether to continue to play or not, i.e., to bet or fold. If the player wishes to fold, the player presses the fold button 157 and the game is over.

If the player wishes to continue to play, he places a number of gaming tokens equal to twice his ante into the ante/bet coin acceptor 140 and presses the deal button 150. This causes the four remaining face down dealer's cards 117, 118, 119 and 120 to be displayed face up. If the dealer's hand has less than an Ace-King combination, the player automatically wins and the player is paid 1 to 1 odds on the amount of his ante and the amount of his bet is returned to him. This payoff is made by incrementing the credit LED display 134 by the number of units which the player has won.

If the dealer has at least an Ace-King combination, then the higher poker hand between the player and the dealer wins. If the player wins, the credit LED display 134 is incremented by the amount that the player wins using the same pay off schedule, including the bonus payments, as is used in the live game.

If the player wishes to utilize the credits displayed on the credit LED 134 to make antes or bets on subsequent hands, he can do so by pressing the ante credits button 152 or the bet credits button 154. The electronic device 100 can be programmed to limit the number of tokens that can be anted on a single hand to say five and the number of tokens which can be bet to twice the number anted, say a maximum of ten. At the conclusion of any hand, the player can cause the electronic device to pay out the number of tokens shown on the credit LED 134 by pressing the cash out button 158. The number of tokens pay out is shown on the paid out LED display 136.

At the beginning of play, in addition to making an ante, a player can also elect to participate in the progressive jackpot component by placing a gaming token in the progressive jackpot coin acceptor 142. This activates the progressive jackpot indicator light 126. If a player is dealt one of the predetermined winning hands, the player wins a predetermined amount of the progressive jackpot. If the winning amount is a fixed number of tokens, that amount is automatically added to the amount shown on the credit LED display 134. If the winning amount is a percentage of the amount shown on a progressive meter (not shown) to which the electronic device is connected, then the player is manually paid by the casino personnel.

Instead of manually inserting gaming tokens into the progressive jackpot con acceptor 142, a player may press the progressive jackpot bet button 156 in which case a unit is deducted from the credit LED display 134 and the progressive jackpot indicator light 126 is activated.

As a further alternative in either the live game or the electronic game, rather than the dealer receiving one card up and four cards down, the dealer may receive two cards up and three down. This would slightly vary the odds in favor of the player. The odds could be varied more toward the dealer by having the dealer receive all of his cards face down. Other variations or modifications will be apparent to those skilled in the art. Accordingly, the invention should not be limited by the foregoing description, but rather should be defined only by the following claims.

We claim:

1. A method of playing a poker game on an electronic device comprising the steps of:

(a) a player anteing a first bet means, (b) electronically displaying a predetermined number of cards representing a player's hand and a dealer's hand, (c) the player either folding in which case the player loses his first bet means, or betting a second bet means, (d) electronically comparing the player's hand to the dealer's hand using poker rank as the criterion for comparison, (e) if the dealer's hand is not at least a predetermined rank, the player wins a preselected amount based on the player's first bet means and the player keeps his second bet means, (f) if the dealer's hand is at least a predetermined rank, and the dealer's hand is higher than the player's hand, the player loses both his first bet means and his second bet means, (g) if the dealer's hand is at least a predetermined rank, and the player's hand is higher than the dealer's hand, then the player wins a first predetermined amount on his first bet means and the player wins a second predetermined amount on his second bet means based on the type of poker hand combination that the player has.

2. The method of claim 1 wherein the predetermined number of cards is five.

3. The method of claim 1 wherein the player's cards are displayed face up.

4. The method of claim 1 wherein some of the dealer's cards are initially displayed face up and the remainder of the dealer's cards are initially displayed face down.

5. The method of claim 4 wherein one of the dealer's cards is initially displayed face up and the rest of the dealer's cards are initially displayed face down.

6. The method of claim 4 wherein two of the dealer's cards are initially displayed face up and the rest of the dealer's cards are initially displayed face down.

7. The method of claim 1 wherein the second bet means is a multiple of the first bet means.

8. The method of claim 7 wherein the second bet means is double the first bet means.

9. The method of claim 1 wherein the cards that are electronically displayed are standard playing cards.

10. The method of claim 9 wherein the predetermined rank is an Ace-King combination.

11. The method of claim 1 wherein the preselected amount that a player wins on the player's first bet means is one-to-one odds.

12. The method of claim 1 wherein the first predetermined amount that a player wins on his first bet means is one-to-one odds.

13. The method of claim 1 wherein the second predetermined amount that a player wins on his second bet means is according to the following schedule:

| Poker Hand | Odds |
|---|---|
| Royal Flush | 250-to-1 |
| Straight Flush | 50-to-1 |
| Four of a Kind | 20-to-1 |
| Full House | 7-to-1 |
| Flush | 5-to-1 |
| Straight | 4-to-1 |
| Three of a Kind | 3-to-1 |
| Two Pair | 2-to-1 |
| Any other hand | 1-to-1 |

14. The method of claim 1 wherein the player antes his first bet means by placing a gaming token into a coin acceptor.

15. The method of claim 1 wherein the player antes his first bet means by activating a button that deducts a unit from a credit LED display and registers the ante as being made on an ante LED display.

16. The method of claim 1 wherein the player bets his second bet means by placing a gaming token into a coin acceptor.

17. The method of claim 1 wherein the player bets his second bet means by activating a button that deducts a unit from a credit LED display and registers the bet as being made on a bet LED display.

18. The method of claim 1 wherein the player's winning amount is automatically displayed on a credit LED display.

19. The method of claim 1 further including the step of dispensing the amount the player wins into a tray mounted on the electronic device.

20. A method of playing a poker game on an electronic device comprising the steps of:

(a) a player anteing a first bet means, (b) electronically displaying a predetermined number of cards representing a player's hand and a dealer's hand, (c) the player either folding in which case the player loses his first bet means, or betting a second bet means, (d) electronically comparing the player's hand to the dealer's hand using poker rank as the criterion for comparison, (e) if the dealer's hand is not at least a predetermined rank, the player wins a preselected amount based on the player's first bet means and the player keeps his second bet means, (f) if the dealer's hand is at least a predetermined rank, and the dealer's hand is higher than the player's hand, the player loses both his first bet means and his second bet means, (g) if the dealer's hand is at least a predetermined rank, and the player's hand is higher than the dealer's hand, then the player wins a first predetermined amount on his first bet means and the player wins a second predetermined amount on his second bet means based on the type of poker hand combination that the player has, said second predetermined amount having a potential return of at least twenty times the amount of the second bet means.

21. The method of claim 20 wherein the predetermined number of cards is five.

22. The method of claim 20 wherein the player's cards are displayed face up.

23. The method of claim 20 wherein some of the dealer's cards are initially displayed face up and the remainder of the dealer's cards are initially displayed face down.

24. The method of claim 23 wherein one of the dealer's cards is initially displayed face up and the rest of the dealer's cards are initially displayed face down.

25. The method of claim 23 wherein two of the dealer's cards are initially displayed face up and the rest of the dealer's cards are initially displayed face down.

26. The method of claim 20 wherein the second bet means is a multiple of the first bet means.

27. The method of claim 26 wherein the second bet means is double the first bet means.

28. The method of claim 20 wherein the cards that are electronically displayed are standard playing cards.

29. The method of claim 28 wherein the predetermined rank is an Ace-King combination.

30. The method of claim 20 wherein the preselected amount that a player wins on the player's first bet means is one-to-one odds.

31. The method of claim 20 wherein the first predetermined amount that a player wins on his first bet means is one-to-one odds.

32. The method of claim 20 wherein the second predetermined amount that a player wins on his second bet means is according to the following schedule:

| Poker Hand | Odds |
|---|---|
| Royal Flush | 250-to-1 |
| Straight Flush | 50-to-1 |
| Four of a Kind | 20-to-1 |
| Full House | 7-to-1 |
| Flush | 5-to-1 |
| Straight | 4-to-1 |
| Three of a Kind | 3-to-1 |
| Two Pair | 2-to-1 |

-continued

| Poker Hand | Odds |
|---|---|
| Any other hand | 1-to-1 |

33. The method of claim 20 wherein the player antes his first bet means by placing a gaming token into a coin acceptor.

34. The method of claim 20 wherein the player antes his first bet means by activating a button that deducts a unit from a credit LED display and registers the ante as being made of an ante LED display.

35. The method of claim 20 wherein the player bets his second bet means by placing a gaming token into a coin acceptor.

36. The method of claim 20 wherein the player bets his second bet means by activating a button that deducts a unit from a credit LED display and registers the bet as being made on a bet LED display.

37. The method of claim 20 wherein the player's winning amount is automatically displayed on a credit LED display.

38. The method of claim 20 further including the step of dispensing the amount the player wins into a tray mounted on the electronic device.

* * * * *